US009185775B2

(12) United States Patent
Hasegawa et al.

(10) Patent No.: US 9,185,775 B2
(45) **Date of Patent: *Nov. 10, 2015**

(54) LIGHTING DEVICE AND LIGHTING FIXTURE

(71) Applicant: Panasonic Corporation, Osaka (JP)

(72) Inventors: Junichi Hasegawa, Osaka (JP); Hiroshi Kido, Osaka (JP); Akinori Hiramatu, Nara (JP); Takeshi Kamoi, Kyoto (JP); Shigeru Ido, Osaka (JP); Nobutoshi Matsuzaki, Osaka (JP); Daisuke Yamahara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/176,229

(22) Filed: Feb. 10, 2014

(65) Prior Publication Data

US 2014/0225506 A1 Aug. 14, 2014

(30) Foreign Application Priority Data

Feb. 13, 2013 (JP) ..... 2013-025254

(51) Int. Cl.
*H01J 7/24* (2006.01)
*H05B 37/02* (2006.01)
*H05B 33/08* (2006.01)

(52) U.S. Cl.
CPC ..... *H05B 37/02* (2013.01); *H05B 33/0803* (2013.01)

(58) Field of Classification Search
CPC ..... H05B 37/02; H05B 37/0227; H05B 37/0218; H05B 37/029; H05B 33/0815; H05B 41/36; H05B 41/3925; H05B 33/0803; H01J 19/36; Y02B 20/46; Y02B 20/202
USPC ..... 315/117, 118, 224, 291, 307, 308, 312, 315/318
See application file for complete search history.

(56) References Cited

U.S. PATENT DOCUMENTS

| | | | | |
|---|---|---|---|---|
| 7,213,940 | B1 * | 5/2007 | Van De Ven et al. | 362/231 |
| 7,609,018 | B2 * | 10/2009 | Lin et al. | 318/471 |
| 8,087,787 | B2 * | 1/2012 | Medin | 353/52 |
| 8,278,846 | B2 * | 10/2012 | Roberts et al. | 315/308 |
| 2010/0027276 | A1 | 2/2010 | Kornitz et al. | |
| 2010/0204841 | A1 | 8/2010 | Chemel et al. | |
| 2010/0237697 | A1 | 9/2010 | Dunn et al. | |
| 2012/0161633 | A1 | 6/2012 | Nishitani et al. | |

FOREIGN PATENT DOCUMENTS

| | | |
|---|---|---|
| CN | 202677230 U | 1/2013 |
| JP | 2011-150936 | 8/2011 |
| WO | WO 2009033051 A1 | 3/2009 |
| WO | WO 2010099187 A2 | 9/2010 |

OTHER PUBLICATIONS

English translation of Chinese Office Action and Search Report for corresponding Chinese Application No. 20140049725.x dated Jul. 22, 2015.

* cited by examiner

*Primary Examiner* — Haissa Philogene
(74) *Attorney, Agent, or Firm* — Renner, Otto, Boisselle & Sklar, LLP

(57) ABSTRACT

The lighting device of the present invention includes: a power source configured to supply power to a plurality of light sources; and a cooling control circuit configured to control a plurality of cooling devices for respectively cooling the plurality of light sources. The cooling control circuit includes a power supply circuit, a plurality of output circuits, a plurality of temperature measurement circuits, and an output control circuit. The power supply circuit outputs a constant voltage by use of power from the power source. The output circuits receive the constant voltage from the power supply circuit and supply drive voltages to the plurality of cooling devices respectively. The temperature measurement circuits measure temperatures of the plurality of light sources respectively. The output control circuit regulates the drive voltages respectively supplied from the plurality of output circuits based on the temperatures respectively measured by the plurality of temperature measurement circuits.

12 Claims, 9 Drawing Sheets

FIG. 13

| FIRST DETECTION VOLTAGE | FIRST CONTROL DATA SET | SECOND DETECTION VOLTAGE | SECOND CONTROL DATA SET |
|---|---|---|---|
| 0 | A0 | 0 | A0 |
| 1 | A0 | 1 | A0 |
| ⋮ | ⋮ | ⋮ | ⋮ |
| 100 | A0 | 100 | A0 |
| 101 | A1 | 101 | B1 |
| ⋮ | ⋮ | ⋮ | ⋮ |
| 255 | A155 | 255 | B155 |

FIG. 14

| FIRST DETECTION VOLTAGE | FIRST CONTROL DATA SET | SECOND DETECTION VOLTAGE | SECOND CONTROL DATA SET |
|---|---|---|---|
| 0 | TA0 | 0 | TB0 |
| 1 | TA1 | 1 | TB1 |
| ⋮ | ⋮ | ⋮ | ⋮ |
| 255 | TA255 | 255 | TB255 |

LIGHTING DEVICE AND LIGHTING FIXTURE

TECHNICAL FIELD

The present invention relates to a lighting device and a lighting fixture using the same.

BACKGROUND ART

In the past, there has been proposed an LED lighting device including a driving circuit for a cooling device for cooling an LED used as a light source. For example, such an LED lighting device is disclosed in document 1 (JP 2011-150936 A).

The LED lighting device disclosed in this document 1 includes: a DC power source; a series circuit connected between output terminals of the DC power source and constituted by connecting a plurality of LEDs; and a cooling device driver for dissipating heat generated by the LEDs. The cooling device driver is connected in parallel with at least one LED of the series circuit. Thus, a DC voltage developed across the at least one LED of the series circuit is supplied to the cooling device driver.

However, in the future, an output of an LED is expected to be more increased. Such an increase would cause an increase in a forward current supplied, and also cause an increase in a forward current supplied to an LED for providing power for the cooling device. Hence, according to the prior art, it is necessary to use an LED able to resist an increase in a forward current as the LED for providing power for the cooling device. This causes an increase in a production cost.

In addition, when a plurality of high power LEDs are employed, a metal member such as a heat dissipation member (e.g., a heatsink) for dissipating heat of the LEDs is necessary. In some cases, a cooling device for cooling the heat dissipation member is needed. Further, when a plurality of light sources constituted by LEDs are employed, each light source requires a cooling device. However, such lighting fixtures to be used may have different structures and different heat dissipation structures. This causes a disadvantage that it is necessary to design an optimal configuration of a power source circuit for a cooling device for each lighting fixture.

SUMMARY OF INVENTION

In view of the above insufficiency, the present invention has been aimed to propose a lighting device and a lighting fixture which are manufactured with a lowered cost and do not require a change of a configuration of a power supply circuit depending on a structure of the lighting fixture and a heat dissipation structure.

The lighting device of the first aspect in accordance with the present invention includes: a power source and a cooling control circuit. The power source is configured to supply power to a plurality of light sources. The cooling control circuit is configured to control a plurality of cooling devices for respectively cooling the plurality of light sources. The cooling control circuit includes a power supply circuit, a plurality of output circuits, a plurality of temperature measurement circuits, and an output control circuit. The power supply circuit is configured to output a constant voltage by use of power from the power source. The plurality of output circuits are configured to receive the constant voltage from the power supply circuit and supply drive voltages to the plurality of cooling devices to drive the plurality of cooling devices, respectively. The plurality of temperature measurement circuits are configured to measure temperatures of the plurality of light sources respectively. The output control circuit is configured to regulate the drive voltages to be respectively supplied from the plurality of output circuits based on the temperatures respectively measured by the plurality of temperature measurement circuits.

With regard to the lighting device of the second aspect in accordance with the present invention, in addition to the first aspect, the output control circuit is configured to calculate an average temperature in a predetermined period for each of the plurality of temperature measurement circuits, and regulate each of the drive voltages of the plurality of output circuits based on the average temperatures of a corresponding one of the plurality of temperature measurement circuits.

With regard to the lighting device of the third aspect in accordance with the present invention, in addition to the first or second aspect, the output control circuit is configured to, when determining that all the temperatures respectively measured by the plurality of temperature measurement circuits are not greater than a first temperature, regulate the drive voltages of the plurality of output circuits to a same voltage. The output control circuit is configured to, when determining that at least one of the temperatures respectively measured by the plurality of temperature measurement circuits is greater than the first temperature, regulate the drive voltages of the plurality of output circuits to different voltages.

With regard to the lighting device of the fourth aspect in accordance with the present invention, in addition to the first or second aspect, the output control circuit has a plurality of correspondence information pieces each defining a correspondence relation between the temperatures and the drive voltages. The output control circuit is configured to determine the drive voltages of the plurality of output circuits based on the temperatures respectively measured by the plurality of temperature measurement circuits by use of the plurality of correspondence information pieces. The plurality of correspondence information pieces have the same correspondence relation between the temperatures and the drive voltages in a range of equal to or less than a first temperature, and have different correspondence relations between the temperatures and the drive voltages in a range of more than the first temperature.

With regard to the lighting device of the fifth aspect in accordance with the present invention, in addition to any one of the first to fourth aspects, the output control circuit is configured to operate the plurality of output circuits singly in order.

With regard to the lighting device of the sixth aspect in accordance with the present invention, in addition to any one of the first to fifth aspects, the lighting device further includes a dimming circuit configured to dim the plurality of light sources by regulating power supplied from the power source to the plurality of light sources. The dimming circuit is configured to, when determining that at least one of the temperatures respectively measured by the plurality of temperature measurement circuits exceeds a second temperature, decrease the power supplied from the power source to the plurality of light sources.

With regard to the lighting device of the seventh aspect in accordance with the present invention, in addition to any one of the first to sixth aspects, each of the plurality of temperature measurement circuits includes a thermosensitive device having a characteristic value varying with a temperature.

With regard to the lighting device of the eighth aspect in accordance with the present invention, in addition to the seventh aspect, the thermosensitive device is an NTC thermistor, a PTC thermistor, or a CTR thermistor.

With regard to the lighting device of the ninth aspect in accordance with the present invention, in addition to any one of the first to eighth aspects, each of the plurality of cooling devices is configured to increase a cooling capacity thereof with an increase in the drive voltage supplied thereto. The output control circuit is configured to increase the drive voltage with regard to each of the plurality of the output circuits with an increase in the temperature measured by a corresponding one of the plurality of temperature measurement circuits.

With regard to the lighting device of the tenth aspect in accordance with the present invention, in addition to any one of the first to ninth aspects, the power source includes: a first circuit and a second circuit. The first circuit is configured to generate an output voltage which is constant. The second circuit is configured to supply power to the plurality of light sources by use of the output voltage generated by the first circuit. The power supply circuit is configured to output the constant voltage by use of the output voltage generated by the first circuit.

With regard to the lighting device of the eleventh aspect in accordance with the present invention, in addition to any one of the first to tenth aspects, each of the plurality of light sources is a solid state light emitting device.

The lighting fixture of the twelfth aspect in accordance with the present invention includes: a fixture body for holding a plurality of light sources and a plurality of cooling devices; and a lighting device according to any one of the first to eleventh aspects, for controlling the plurality of light sources and the plurality of cooling devices.

BRIEF DESCRIPTION OF THE DRAWINGS

FIG. 13 is a diagram illustrating an example of a data table of the above output control circuit;

FIG. 14 is a diagram illustrating another example of the data table of the above output control circuit;

DESCRIPTION OF EMBODIMENTS

The following explanation referring to drawings is made to a lighting device of one embodiment in accordance with the present invention. Note that, in the present embodiment, the expression "plurality of" means "two or more".

Figure 1:
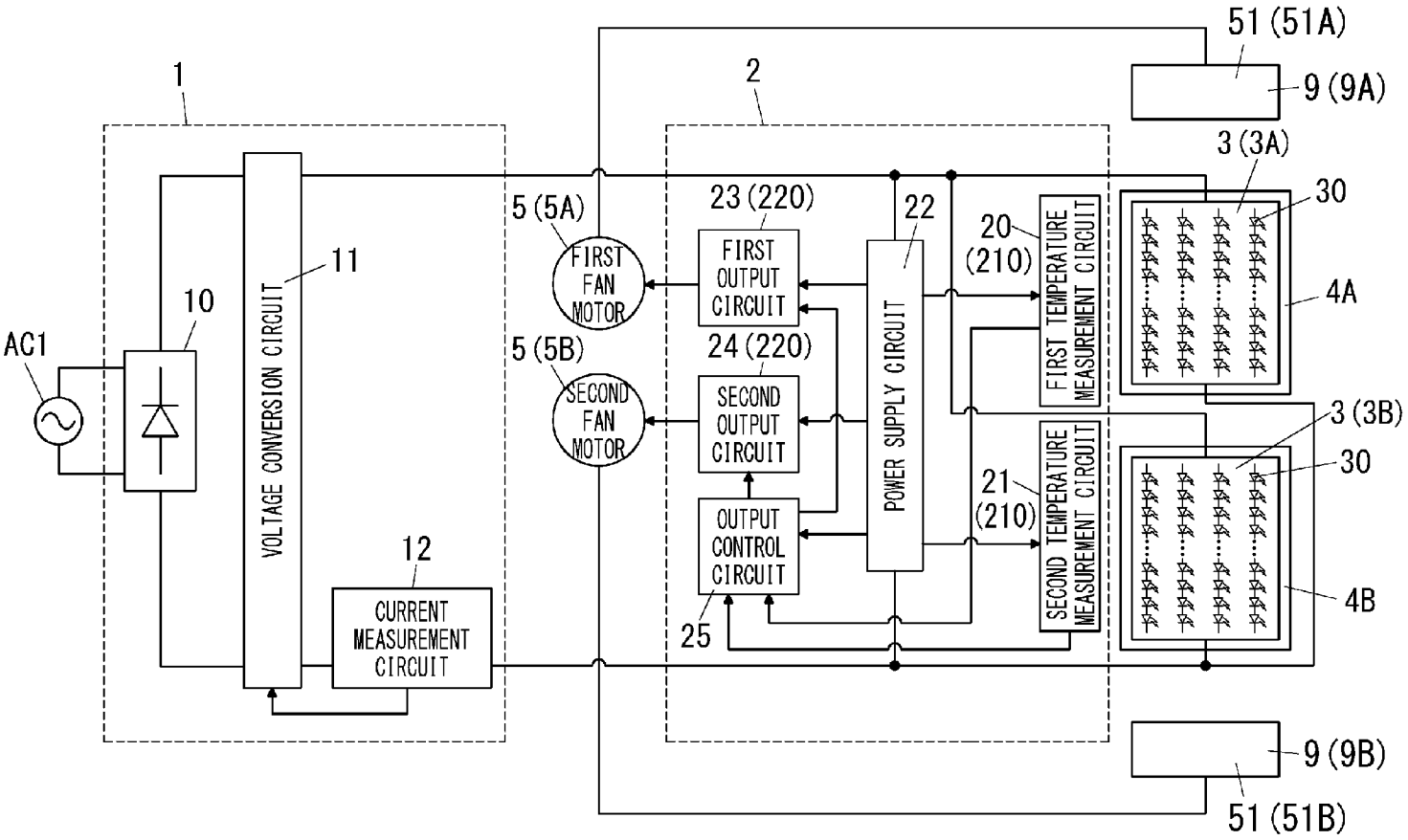
FIG. 1 is a schematic circuit diagram illustrating a lighting device of one embodiment in accordance with the present invention.
Figure 2:
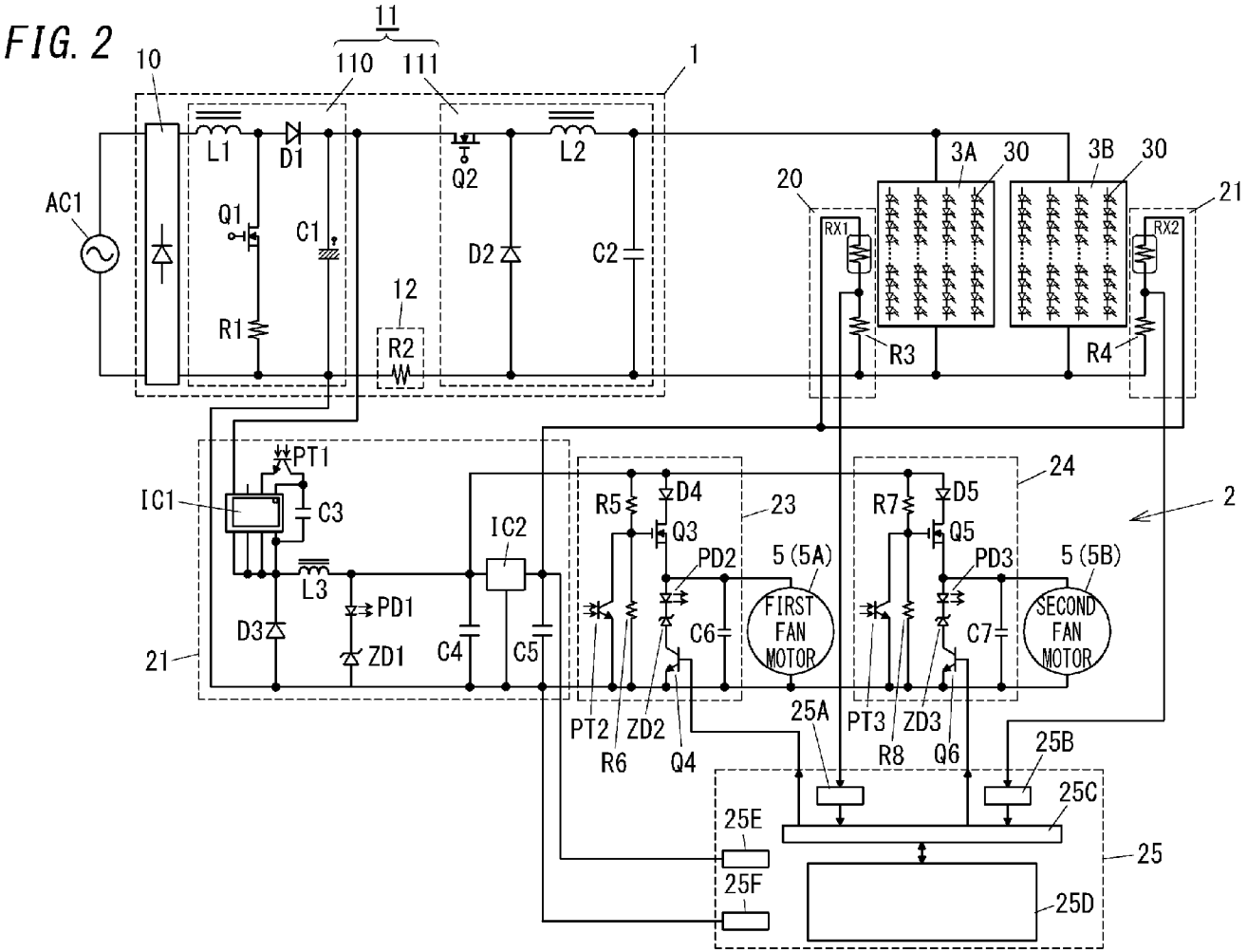
FIG. 2 is a concrete circuit diagram illustrating the above lighting device.

As shown in FIGS. 1 and 2, the lighting device of the present embodiment includes a power source (DC power source) 1 and a cooling control circuit 2. The lighting device of the present embodiment is used for operating a plurality of (two, in the present embodiment) light sources 3 (a first light source 3A and a second light source 3B).

The voltage source (DC voltage source) 1 supplies power to the plurality of light sources 3. For example, the DC voltage source 1 is configured to convert AC power from a commercial AC power source AC1 into DC power and provide the resultant DC power. The DC voltage source 1 includes a rectifier 10, a voltage conversion circuit 11, and a current measurement circuit 12. Alternatively, the DC voltage source 1 may be configured to covert DC power from another DC power source into predetermined DC power (predetermined DC voltage) and provide the resultant DC power. Or, the DC voltage source 1 may be constituted by a battery (circuit including a battery).

The rectifier 10 is constituted by a diode bridge circuit, for example. The rectifier 10 is configured to perform full-wave rectification on an AC current from the commercial AC power source AC1 and thereby output a pulsating voltage.

As shown in FIG. 2, the voltage conversion circuit 11 includes a step-up chopper circuit (first circuit) 110 and a step-down chopper circuit (second circuit) 111.

The step-up chopper circuit (first power supply circuit) 110 generates an output voltage which is constant. For example, the step-up chopper circuit 110 includes an inductor L1, a switching device Q1, a diode D1, a smoothing capacitor C1, and a resistor R1, and is used for improving a power factor. The resistor R1 is connected in series with the switching device Q1 to detect a current flowing through the switching device Q1. The step-up chopper circuit 110 regulates the output voltage to a constant voltage by turning on and off the switching device Q1 depending on the current detected by the resistor R1. Note that, the step-up chopper circuit 110 may be substituted with the smoothing capacitor C1 only.

The step-down chopper circuit (second power supply circuit) 111 is configured to supply power to the plurality of light sources 3 by use of the output voltage generated by the step-up chopper circuit 110. For example, the step-down chopper circuit 111 includes an inductor L2, a switching device Q2, a diode D2, and a smoothing capacitor C2. The step-down chopper circuit 111 is configured to decrease the output voltage from the step-up chopper circuit 110 and output the resultant voltage.

For example, the current measurement circuit 12 may be constituted by a resistor R2. The current measurement circuit 12 is configured to detect load currents flowing through the respective light sources 3A and 3B.

The step-down chopper circuit 111 regulates an output current or output power to be constant by turning on and off the switching device Q2 depending on the load currents detected by the current measurement circuit 12. Note that, the step-down chopper circuit 111 can be substituted with an isolated DC/DC converter such as a flyback converter.

The DC voltage source 1 supplies its output voltage to the first light source 3A and the second light source 3B. In brief, the DC voltage source 1 is a voltage source for supplying power to a light source configured to light up when energized.

As shown in FIG. 2, each of the light sources 3 (3A and 3B) is constituted by a plurality of LEDs 30 which are solid state light emitting devices and are connected in series, parallel, or series-parallel. The light sources 3A and 3B are connected in parallel with each other between output ends of the DC power source 1. The light sources 3A and 3B are turned on when currents flow through the LEDs 30 by applying the output voltage of the DC power source 1. The light sources 3A and 3B can be dimmed by changing currents flowing through the LEDs 30 by changing the output current of the DC power source 1.

Note that, a dimming circuit (not shown) may be interposed between the DC voltage source 1 and a set of the light sources 3A and 3B. The output voltage of the DC power source 1 may be supplied to the light sources 3A and 3B intermittently by performing PWM control on the output voltage of the DC power source 1 by use of the dimming circuit. The dimming circuit is only required to dim the light sources 3A and 3B by varying the output of the DC voltage source 1. Such a dimming circuit is well known and an explanation thereof is deemed unnecessary.

The light sources 3A and 3B are mounted on a substrate (first substrate) 4A and a substrate (second substrate) 4B, respectively. Each of the substrates 4A and 4B has a high heat dissipation property and includes a base made of metal material. Note that, the substrates 4A and 4B are not limited to substrates having bases made of metal material. The substrates 4A and 4B may have bases made of one of ceramic material and synthetic resin material which have fine heat dissipation properties and fine durability.

In the present embodiment, the light sources 3A and 3B are mounted on the substrates 4A and 4B respectively in such a chip-on-board manner that bare chips of the LEDs 30 of the light sources 3A and 3B are directly mounted on the substrates 4A and 4B respectively. Note that, in the present embodiment, the bare chips of the LEDs 30 are mounted on the substrates 4A and 4B by bonding the bare chips of the LEDs 30 to the substrates 4A and 4B with adhesive such as silicone resin adhesive.

For example, the bare chip of the LED 30 is formed by disposing a light-emitting layer on a transparent or translucent sapphire substrate. The light-emitting layer is formed by stacking an n-type nitride semiconductor layer, an InGaN layer, and a p-type nitride semiconductor layer. The p-type nitride semiconductor layer is provided with a p-type electrode pad serving as a positive electrode. The n-type nitride semiconductor layer is provided with an n-type electrode pad serving as a negative electrode. These electrodes are electrically connected to electrodes on the substrate 4A, 4B via bonding wires made of metal material such as gold. In the present embodiment, the LED 30 combines light from an InGaN-base blue LED and light from yellow phosphor to produce white light.

In this regard, a method for mounting the LEDs 30 on the substrates 4A and 4B is not limited to the chip-on-board manner. For example, the bare chips of the LEDs 30 may be housed in packages, and the packages may be mounted on the substrates 4A and 4B in a surface mounting technology.

As shown in FIG. 2, the cooling control circuit 2 includes a plurality of (two, in the present embodiment) temperature measurement circuits 210 (a first temperature measurement circuit 20 and a second temperature measurement circuit 21), a power supply circuit 22, a plurality of (two, in the present embodiment) output circuits 220 (a first output circuit 23 and a second output circuit 24), and an output control circuit 25.

The temperature measurement circuits 210 (20 and 21), which are disposed in vicinities of the light sources 3 (3A and 3B) measure temperatures of the light sources 3 (3A and 3B), respectively.

The first temperature measurement circuit 20 includes a series circuit of a thermosensitive device RX1 and a resistor R3, for example. The first temperature measurement circuit 20 divides the power supply voltage, which is supplied from the power supply circuit 22, and outputs the divided voltage to the output control circuit 25 as a detection voltage (first detection voltage).

The second temperature measurement circuit 21 includes a series circuit of a thermosensitive device RX2 and a resistor R4, for example. The second temperature measurement circuit 21 divides the power supply voltage, which is supplied from the power supply circuit 22, and outputs the divided voltage to the output control circuit 25 as a detection voltage (second detection voltage).

In the present embodiment, an NTC thermistor whose resistance decreases with an increase in temperature is used as each of the thermosensitive devices RX1 and RX2. Thus, the detection voltages vary with a change in the temperatures of the light sources 3A and 3B. Note that, each of the thermosensitive devices RX1 and RX2 may be a PTC thermistor whose resistance increases with an increase in temperature, or a CTR thermistor whose resistance rapidly decreases when its temperature exceeds a certain temperature.

The power supply circuit 22 receives the output voltage from the DC power source 1 and generates the power supply voltage to be supplied for each of the temperature measurement circuits 20 and 21, the output circuits 23 and 24, and the output control circuit 25.

For example, as shown in FIG. 2, the power supply circuit 22 includes a semiconductor device IC1, a diode D3, an inductor L3, capacitors C3 and C4, a photodiode PD1, a phototransistor PT1, and a zener diode ZD1.

Additionally, the power supply circuit 22 includes a semiconductor device IC2 and a capacitor C5. The semiconductor device IC2 is a three-terminal regulator. The capacitor C5 is connected between a power terminal 25E and a ground terminal 25F of the output control circuit 25. Further, each of the temperature measurement circuits 210 (20 and 21) is connected to a connection point between the capacitor C5 and the semiconductor device IC2.

For example, the semiconductor device IC1 is constituted by use of LNK302 available from POWER INTEGRATIONS, and includes a switching device and a control circuit therefor which are not shown. Further, the photodiode PD1 and the phototransistor PT1 constitute a photo coupler.

Hereinafter, operation of the power supply circuit 22 is described.

While a switching device inside the semiconductor device IC1 is in an ON-state, a current flows through the semiconductor device IC1 and the inductor L3, and therefore the capacitor C4 is charged. When a voltage across the capacitor C4 exceeds a zener voltage of the zener diode ZD1, a current flows through the zener diode ZD1 and the photodiode PD1, and then the phototransistor PT1 is turned on. Consequently, the switching device inside the semiconductor device IC1 is turned off, and thus power supply to the semiconductor device IC1 and the inductor L3 is interrupted.

Thereafter, when the voltage across the capacitor C4 falls below the zener voltage of the zener diode ZD1 after the capacitor C4 starts to discharge, no current flows through the photodiode PD1. Hence, the phototransistor PT1 is turned off, and the switching device inside the semiconductor device IC1 is turned on.

By repeating the action described above, the voltage across the capacitor C4 is kept a constant DC voltage. The voltage across the capacitor C4 is supplied to the output circuits 23 and 24 as a power supply voltage. Further, the voltage across the capacitor C4 is converted into another constant DC voltage different from the voltage across the capacitor C4, through the semiconductor IC2 and the capacitor C5. Consequently, a voltage (constant voltage) across the capacitor C5 is supplied to the temperature measurement circuits 20 and 21 and the output control circuit 25 as the power supply voltage.

As described above, the power supply circuit 22 outputs the constant voltage by use of power supplied from the power source (DC power source) 1. Especially, in the present embodiment, the power supply circuit 22 outputs the constant voltage by use of the output voltage generated by the step-up chopper circuit (first circuit) 110.

Note that, the power supply circuit 22 is constituted by the semiconductor device IC1 including the switching device and the control circuit for the switching device which are integrated. However, the power supply circuit 22 may have another configuration. For example, the power supply circuit 22 may generate the power supply voltage by use of a voltage induced in an auxiliary winding provided to the inductor L1 of the step-up chopper circuit 110. Alternatively, in the power supply circuit 22, the semiconductor device IC1 may be replaced with the switching device and the control circuit for the switching device which are separate parts.

The plurality of output circuits 220 (the first output circuit 23 and the second output circuit 24) receive the constant voltage (power supply voltage) from the power supply circuit 22 and supply the drive voltages to plurality of (two, in the present embodiment) cooling devices 9 (the first cooling device 9A and the second cooling device 9B), respectively.

The first output circuit 23 receives the output voltage from the power supply circuit 22, and supplies the drive voltage to a first fan motor 5A of a first fan 51A serving as the cooling device (first cooling device) 9A for cooling the first light source 3A. An air volume of the first fan 51A is varied according to the drive voltage outputted from the first output circuit 23.

The first cooling device 9A includes the fan 51 (the first fan 51A) and the fan motor 5 (the first fan motor 5A) configured to drive the fan 51A. For example, the cooling device 9A is configured to increase a cooling capacity thereof with an increase in the drive voltage supplied thereto. In brief, as the supplied drive voltage is increased, the cooling device 9A increase an amount of heat removed from the corresponding light source 3A of the plurality of light sources 3 (3A and 3B).

The second output circuit 24 receives the output voltage from the power supply circuit 22, and supplies the drive voltage to a second fan motor 5B of a second fan 51B serving as the cooling device (second cooling device) 9B for cooling the second light source 3B. An air volume of the second fan 51B is varied according to the drive voltage outputted from the second output circuit 24.

The second cooling device 9B includes the fan 51 (the second fan 51B) and the fan motor 5 (the second fan motor 5B) configured to drive the fan 51B. For example, the cooling device 9B is configured to increase a cooling capacity thereof with an increase in the drive voltage supplied thereto. In brief, as the supplied drive voltage is increased, the cooling device 9B increase an amount of heat removed from the corresponding light source 3B of the plurality of light sources 3 (3A and 3B).

For example, as shown in FIG. 2, the first output circuit 23 includes resistors R5 and R6, a diode D4, switching devices Q3 and Q4, a photodiode PD2, a phototransistor PT2, a zener diode ZD2, and a capacitor C6. The switching device Q3 is an n-type MOSFET. The switching device Q4 is an npn-type transistor. Further, the photodiode PD2 and the phototransistor PT2 constitute a photo coupler.

For example, as shown in FIG. 2, the second output circuit 24 includes resistors R7 and R8, a diode D5, switching devices Q5 and Q6, a photodiode PD3, a phototransistor PT3, a zener diode ZD3, and a capacitor C7. The switching device Q5 is an n-type MOSFET. The switching device Q6 is an npn-type transistor. Further, the photodiode PD3 and the phototransistor PT3 constitute a photo coupler.

In the present embodiment, the plurality of output circuits 220 (the first output circuit 23 and the second output circuit 24) have the same circuit configuration. However, the plurality of output circuits 220 (the first output circuit 23 and the second output circuit 24) may have different circuit configurations.

The output control circuit 25 regulates the drive voltages respectively outputted from the plurality of output circuits 220 based on the temperatures respectively measured by the plurality of temperature measurement circuits 210. In the present embodiment, the output control circuit 25 controls the drive voltage of the first output circuit 23 based on the temperature measured by the first temperature measurement circuit 20. Accordingly, the first cooling device 9A cools the first light source 3A based on the temperature of the first light source 3A. Further, the output control circuit 25 controls the drive voltage of the second output circuit 24 based on the temperature measured by the second temperature measurement circuit 21. Accordingly, the second cooling device 9B cools the second light source 3B based on the temperature of the second light source 3B. As described above, each of the plurality of output circuits 220 is associated with the cooling device 9 and the temperature measurement circuit 210 in such a manner that the light source 3 is cooled based on the same light source 3.

The output control circuit 25 is constituted by an 8-bit microcomputer, for example. The output control circuit 25 controls the output circuit 220 (23, 24) to output the drive voltage depending on the temperature measured by the temperature measurement circuit 210 (20, 21).

For example, the output control circuit 25 includes a plurality of (two, in the present embodiment) A/D ports 25A and 25B, a CPU 25C, and a memory 25D. Further, the output control circuit 25 includes the power terminal 25E and the ground terminal 25F, which are described above.

The A/D port 25A has an input terminal connected between the thermosensitive device RX1 and the resistor R3 of the first temperature measurement circuit 20 and has an output terminal connected to the CPU 25C. The A/D port 25B has an input terminal connected between the thermosensitive device RX2 and the resistor R4 of the second temperature measurement circuit 21 and has an output terminal connected to the CPU 25C. The A/D ports 25A and 25B convert detection voltages inputted from the temperature measurement circuits 20 and 21 into digital values and output the resultant digital values to the CPU 25C, respectively.

The CPU 25C calculates an average, in a predetermined period, of the digital value (the digital value indicative of the first detection voltage) inputted from the A/D port 25A, and uses the calculated average as the digital value of the first detection voltage. Similarly, the CPU 25C calculates an average, in a predetermined period, of the digital value (the digital value indicative of the second detection voltage) inputted from the A/D port 25B, and uses the calculated average as the digital value of the second detection voltage.

In summary, the output control circuit 25 is configured to calculate an average temperature in a predetermined period for each of the plurality of temperature measurement circuits 210, and regulate the drive voltages of the plurality of output circuits 220 based on the averages of the plurality of temperature measurement circuits 210.

Figure 3:
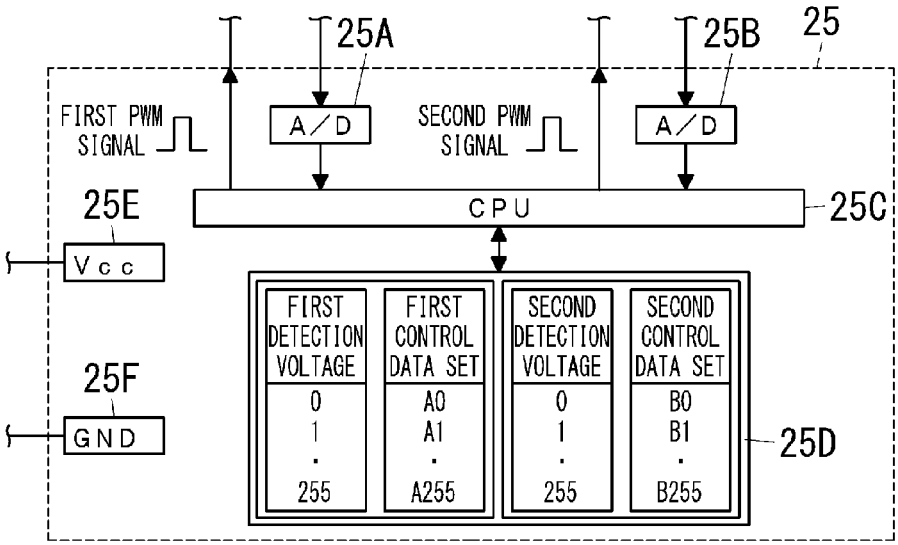
FIG. 3 is a schematic diagram illustrating an output control circuit of the above lighting device.

The memory 25D stores a data table shown in FIG. 3. This data table indicates the digital values of the respective detection voltages and control data sets respectively associated with these digital values. The control data set is data used for controlling the output circuit 220. For example, the control data set is data for determining the magnitude of the drive voltage of the output circuit 240. For example, the control data set is data indicative of a duty cycle of a PWM signal to be outputted to the output circuit 220.

For example, the memory 25D stores the data table (see TABLE 1) dedicated to the first output circuit 23 and the data table (see TABLE 2) dedicated to the second output circuit 24. The data table dedicated to the first output circuit 23 shows a correspondence relation between the first detection voltages (the digital values of the first detection voltage) and first control data sets for the first output circuit 23. The data table dedicated to the second output circuit 24 shows a correspondence relation between the second detection voltages (the digital values of the second detection voltage) and second control data sets for the second output circuit 24. Note that, the digital value of the detection voltage indicates a value corresponding to the detection voltage, and does not necessarily represent the detection voltage itself. For example, the digital value of "5" of the first detection voltage in the data table does not always mean "5 V".

TABLE 1

| FIRST DETECTION VOLTAGE | FIRST CONTROL DATA SET |
|---|---|
| 0 | A0 |
| 1 | A1 |
| . . . | . . . |
| 255 | A255 |

TABLE 2

| SECOND DETECTION VOLTAGE | SECOND CONTROL DATA SET |
|---|---|
| 0 | B0 |
| 1 | B1 |
| . . . | . . . |
| 255 | B255 |

The CPU 25C reads out the first control data set ("A0", "A1", . . . , "A255") and the second control data set ("B0", "B1", . . . , "B255") respectively corresponding to the digital values of the detection voltages from the memory 25D.

The CPU 25C outputs the PWM signals (the first PWM signal and the second PWM signal) based on the control data sets to the switching devices Q4 and Q6 of the output circuits 23 and 24, respectively. In brief, the output control circuit 25 outputs the first PWM signal based on the temperature measured by the first temperature measurement circuit 20 to the first output circuit 23. The output control circuit 25 outputs the second PWM signal based on the temperature measured by the second temperature measurement circuit 21 to the second output circuit 24.

As described above, the output control circuit 25 controls the output circuits 23 and 24 based on the averages in the predetermined period of the temperatures measured by the temperature measurement circuits 20 and 21, respectively. Hence, it is possible to reduce bad effect caused by noise included in the measured temperature (detection voltage). Consequently, false operation can be prevented. Note that, to more reduce the bad effect caused by the noise, it is preferable to use, as the digital value of the detection voltage, an average of the digital values selected from all the digital values obtained during a predetermined period in such a way to exclude maximum and minimum values.

Next, operations of the respective output circuits 220 (the first output circuit 23 and the second output circuit 24) are described.

Figure 4:
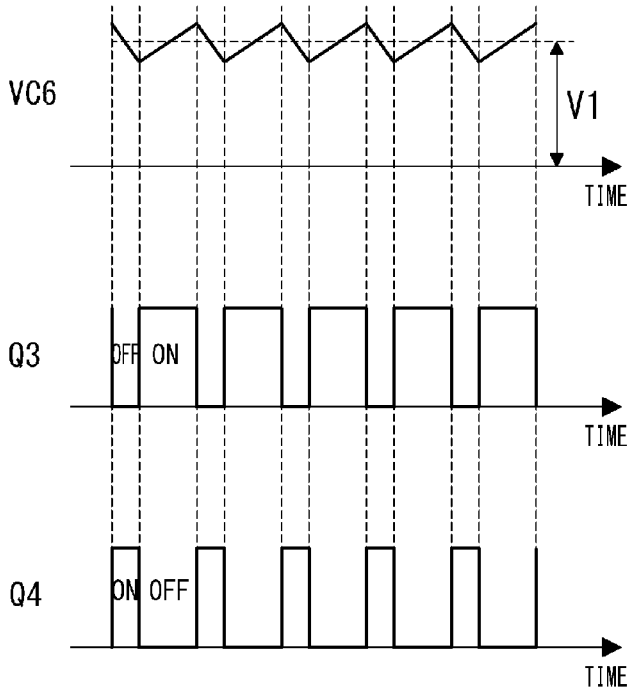
FIG. 4 is a waveform chart illustrating operation of a first output circuit of the above lighting device.

The first explanation referring to FIG. 4 is made to the operation of the first output circuit 23.

In the first output circuit 23, a voltage obtained by dividing the power supply voltage supplied from the power supply circuit 22 with the resistors R5 and R6 is inputted into a gate terminal of the switching device Q3. Hence, normally, the switching device Q3 is kept turned on. In this regard, the first PWM signal is inputted into a base terminal of the switching device Q4. Consequently, the switching device Q4 is turned on and off based on the duty cycle of the first PWM signal.

While the switching device Q4 is turned off, a current flows through the diode D4 and the switching device Q3 and therefore the capacitor C6 is charged.

When a voltage VC6 across the capacitor C6 exceeds a zener voltage of the zener diode ZD2 after the switching device Q4 is turned on, a current flows through the photodiode PD2 and thus the phototransistor PT2 is turned on. Thereafter, the switching device Q3 is turned off, and current supply to the capacitor C6 is interrupted and the capacitor C6 starts to discharge.

When the switching device Q4 is turned off again, a flow of a current through the photodiode PD2 is interrupted, and therefore the phototransistor PT2 is turned off. Hence, the switching device Q3 is turned on and a current starts to flow through the diode D4 and the switching device Q3 and the capacitor C6 is charged again.

By repeating the action described above, the voltage VC6 across the capacitor C6 (i.e., the drive voltage for the first fan motor 5A) is kept a DC voltage V1 which is constant. The DC voltage V1 decreases with an increase in the duty cycle of the first PWM signal, whereas it increases with a decrease in the duty cycle of the first PWM signal. In the instance shown in FIG. 4, the first PWM signal has a duty cycle of 30%.

The duty cycle of the first PWM signal varies with the value of the first control data set. The duty cycle of the first PWM signal has the maximum value when the first control data set is "A0", and the duty cycle of the first PWM signal has the minimum value when the first control data set is "A255". Therefore, when the temperature measured by the first temperature measurement circuit 20 increases, the duty cycle of the first PWM signal decreases and therefore the first output circuit 23 increases the drive voltage and outputs the increased drive voltage. Meanwhile, when the temperature measured by the first temperature measurement circuit 20 decreases, the duty cycle of the first PWM signal increases and therefore the first output circuit 23 decreases the drive voltage and outputs the decreased drive voltage.

As described above, the output control circuit 25 increases the drive voltage of the first output circuit 23 with an increase in the temperature measured by the first temperature measurement circuit 20. Further, the output control circuit 25 decreases the drive voltage of the first output circuit 23 with a decrease in the temperature measured by the first temperature measurement circuit 20.

Figure 5:
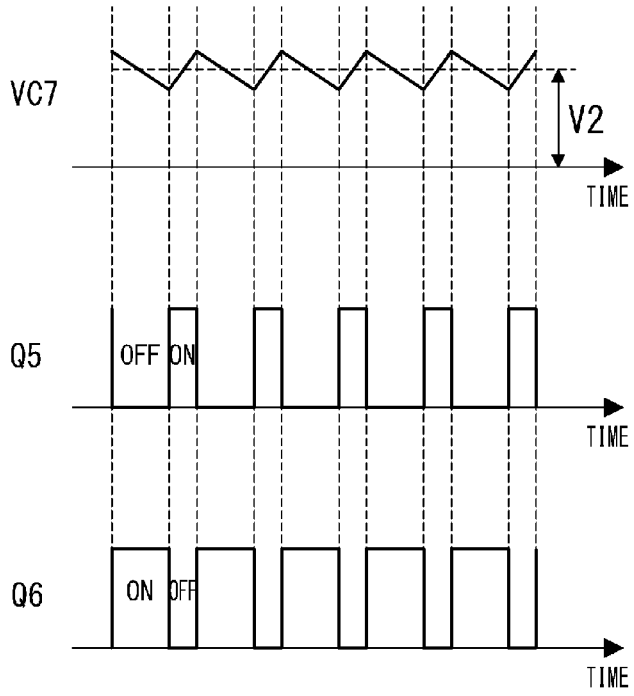
FIG. 5 is a waveform chart illustrating operation of a second output circuit of the above lighting device.

The second explanation referring to FIG. 5 is made to the operation of the second output circuit 24.

In the second output circuit 24, a voltage obtained by dividing the power supply voltage supplied from the power supply circuit 22 with the resistors R7 and R8 is inputted into a gate terminal of the switching device Q5. Hence, normally, the switching device Q5 is kept turned on. In this regard, the second PWM signal is inputted into a base terminal of the switching device Q6. Consequently, the switching device Q6 is turned on and off based on the duty cycle of the second PWM signal.

While the switching device Q6 is turned off, a current flows through the diode D5 and the switching device Q5 and therefore the capacitor C7 is charged.

When a voltage VC7 across the capacitor C7 exceeds a zener voltage of the zener diode ZD3 after the switching device Q6 is turned on, a current flows through the photodiode PD3 and thus the phototransistor PT3 is turned on. Thereafter, the switching device Q5 is turned off, and current supply to the capacitor C7 is interrupted and the capacitor C7 starts to discharge.

When the switching device Q6 is turned off again, a flow of a current through the photodiode PD3 is interrupted, and therefore the phototransistor PT3 is turned off. Hence, the switching device Q5 is turned on and a current starts to flow through the diode D5 and the switching device Q5 and the capacitor C7 is charged again.

By repeating the action described above, the voltage VC7 across the capacitor C7 (i.e., the drive voltage for the second fan motor 5B) is kept a DC voltage V2 which is constant. The DC voltage V2 decreases with an increase in the duty cycle of the second PWM signal, whereas it increases with a decrease in the duty cycle of the second PWM signal. In the instance shown in FIG. 5, the second PWM signal has a duty cycle of 70%.

The duty cycle of the second PWM signal varies with the value of the second control data set. The duty cycle of the second PWM signal has the maximum value when the second control data set is "B0", and the duty cycle of the second PWM signal has the minimum value when the second control data set is "B255". Therefore, when the temperature measured by the second temperature measurement circuit 21 increases, the duty cycle of the second PWM signal decreases and therefore the second output circuit 24 increases the drive voltage and outputs the increased drive voltage. Meanwhile, when the temperature measured by the second temperature measurement circuit 21 decreases, the duty cycle of the second PWM signal increases and therefore the second output circuit 24 decreases the drive voltage and outputs the decreased drive voltage.

As described above, the output control circuit 25 increases the drive voltage of the second output circuit 24 with an increase in the temperature measured by the second temperature measurement circuit 21. Further, the output control circuit 25 decreases the drive voltage of the second output circuit 24 with a decrease in the temperature measured by the second temperature measurement circuit 21.

In summary, the output control circuit 25 is configured to increase the drive voltage with regard to each of the plurality of the output circuits 220 (23 and 24) with an increase in the temperature measured by a corresponding one of the plurality of temperature measurement circuits 210 (20 and 21).

Note that, it is not necessarily that the switching devices Q4 and Q6 are turned on and off simultaneously.

As described above, in the present embodiment, the output circuits 23 and 24 receive the output voltage from the single power supply circuit 22 and output the drive voltages depending on the temperatures measured by the temperature measurement circuits 20 and 21, respectively. Hence, in the present embodiment, there is no need to change the configuration of the power supply circuit to be suitable for a desired lighting fixture each time. For example, even if cooling conditions for the light sources 3A and 3B are different, the cooling conditions for the light sources 3A and 3B can be easily optimized by changing only the outputs from the output circuits 23 and 24. Hence, it is unnecessary to change the configuration of the power supply circuit 22.

Besides, in the present embodiment, LEDs for providing power for cooling devices as disclosed in the prior art are not necessary. Hence, there is no need to use an LED capable of withstanding an increase in a forward current, and therefore the production cost can be reduced. Additionally, in the present embodiment, it is unnecessary to change the configuration of the power supply circuit 22 in accordance with a lighting fixture structure and a heat dissipation structure. Thus, the production cost can be reduced by shortening time necessary to design the device and using common parts. In summary, according to the present embodiment, the production cost can be reduced and there is no need to change the configuration of the power supply circuit in accordance with a lighting fixture structure and a heat dissipation structure.

Further, the present embodiment can regulate the outputs of the respective cooling devices based on the temperatures respectively measured by the temperature measurement circuits 20 and 21. Therefore, it is possible to keep the temperatures of the light sources 3A and 3B optimal. Accordingly, the present embodiment can suppress a decrease in the light output of the LED 30 due to the high temperature and a decrease in the lifetime of the LED 30.

Note that, in the present embodiment, the LED 30 is used as a solid state light emitting device used for each of the light sources 3A and 3B. Alternatively, each of the light sources 3A and 3B may be constituted by another solid state light emitting device such as a semiconductor laser device and an organic EL device. Moreover, the present embodiment is suitable for the two light sources 3A and 3B, but the number of light sources to be controlled is not limited to two. The number of light sources may be one or three or more. For example, a set of a plurality of light sources can be treated as a single light source.

The cooling device 9 is not limited to a fan but may be a thermoelectric device such as a Peltier device. For example, in a case where the cooling device 9 is a Peltier device, each of the output circuits 23 and 24 may be configured to supply a current to a drive circuit of the Peltier device. The present embodiment uses the two output circuits 23 and 24 but may be configured to cool the light sources 3A and 3B by use of three or more output circuits. For example, a set of the plurality of cooling devices can be treated as a single cooling device and a set of the plurality of output circuits can be treated as a single output circuit.

Figure 6:
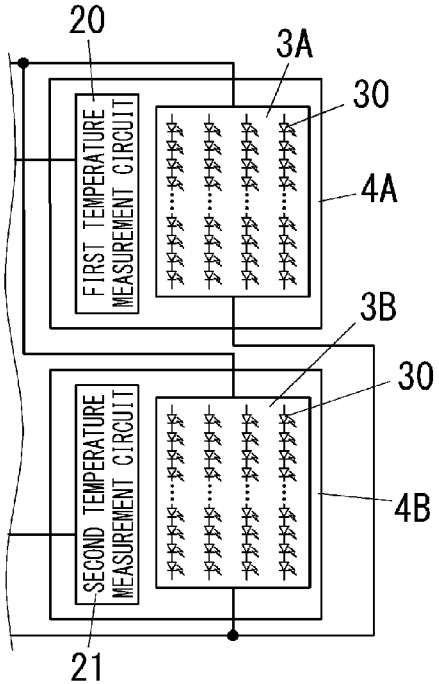
FIG. 6 is a diagram illustrating another example of a configuration where light sources are connected in parallel.

Alternatively, as shown in FIG. 6, the first temperature measurement circuit 20 may be mounted on the first substrate 4A on which the first light source 3A is mounted. Further, the second temperature measurement circuit 21 may be mounted on the second substrate 4B on which the second light source 3B is mounted. In summary, each of the plurality of temperature measurement circuits 210 is mounted on the substrate (4A, 4B) on which the corresponding light source of the plurality of light sources 3 is mounted.

With this arrangement, extra spaces of the substrates 4A and 4B are effectively utilized and therefore the lighting device can be downsized. Further, since the temperature measurement circuits 20 and 21 are disposed closer to the corresponding light sources 3A and 3B, it is possible to measure the temperatures of the light sources 3A and 3B precisely.

Hence, according to this arrangement, in contrast to the arrangement shown in FIGS. 1 and 2, it is easy to keep the temperatures of the light sources 3A and 3B optimal and also it is possible to more suppress a decrease in the light output of the LED 30 caused by the high temperature and a decrease in the lifetime of the LED 30. Note that, instead of an arrangement in which all the components of the temperature measurement circuit 20 are mounted on the substrate 4A and all the components of the temperature measurement circuit 21 are mounted on the substrate 4B, only the thermosensitive devices RX1 and RX2 may be mounted on the substrates 4A and 4B respectively.

Figure 7:
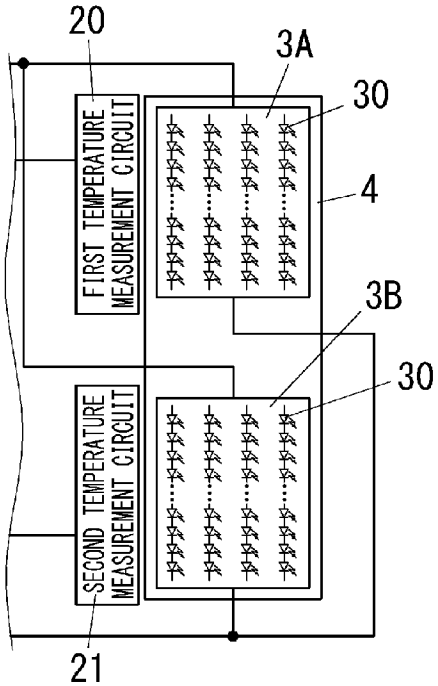
FIG. 7 is a diagram illustrating another example of the configuration where the light sources are connected in parallel.

Alternatively, as shown in FIG. 7, the light sources 3A and 3B may be mounted on a single substrate 4. With this arrangement, even if a temperature imbalance between the light sources 3A and 3B is caused by a variation between the light sources 3A and 3B and a variation between the cooling devices, such an imbalance can be corrected in some extent because the light sources are mounted on the same substrate 4. Hence, according to this arrangement, in contrast to the arrangement shown in FIGS. 1 and 2, it is easy to keep the temperatures of the light sources 3A and 3B optimal and also it is possible to more suppress a decrease in the light output of the LED 30 caused by the high temperature and a decrease in the lifetime of the LED 30.

Figure 8:
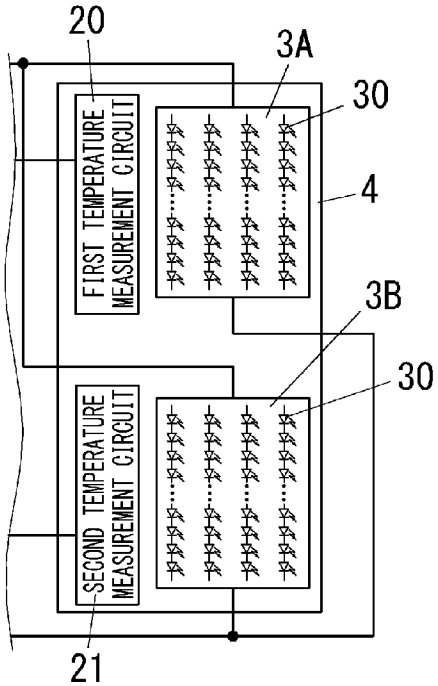
FIG. 8 is a diagram illustrating another example of the configuration where the light sources are connected in parallel.

Alternatively, as shown in FIG. 8, the light sources 3A and 3B and the temperature measurement circuits 20 and 21 may be mounted on the same substrate 4. With the arrangement, both advantageous effects of the arrangement shown in FIG. 6 and the arrangement shown in FIG. 7 may be achieved. Note that, instead of mounting all the components of the temperature measurement circuits 20 and 21 on the substrate 4, only the thermosensitive devices RX1 and RX2 may be mounted on the substrate 4.

Figure 9:
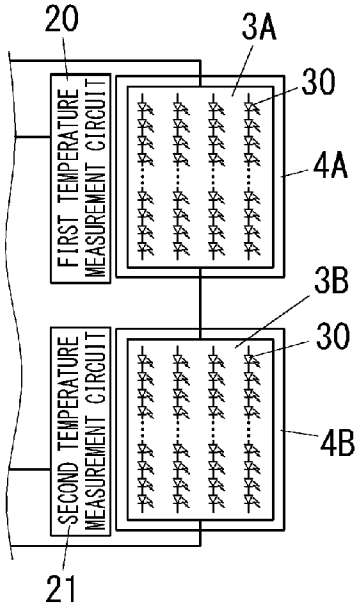
FIG. 9 is a diagram illustrating another example of a configuration where the light sources are connected in series.

Alternatively, as shown in FIG. 9, the light sources 3A and 3B may be connected in series with each other. With this arrangement, in contrast to a case where the light sources 3A and 3B are connected in parallel with each other, it is possible to simplify wiring. Further, according to this arrangement, when a temperature of any of the light sources 3A and 3B increases rapidly, the light sources 3A and 3B may be dimmed such that the outputs thereof are decreased. Therefore, a user may be visually aware of occurrence of abnormality of any of the light sources 3A and 3B through a change in the light output.

Figure 10:
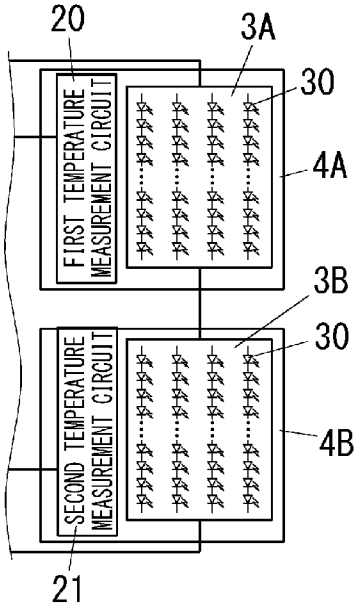
FIG. 10 is a diagram illustrating another example of the configuration where the light sources are connected in series.

Alternatively, as shown in FIG. 10, the first temperature measurement circuit 20 may be mounted on the first substrate 4A on which the first light source 3A is mounted. Further, the second temperature measurement circuit 21 may be mounted on the second substrate 4B on which the second light source 3B is mounted. This arrangement can provide the advantageous effect of the arrangement shown in FIG. 6 in addition to an advantageous effect of the arrangement where the light sources 3A and 3B are connected in series with each other. Note that, instead of an arrangement in which all the components of the temperature measurement circuit 20 are mounted on the substrate 4A and all the components of the temperature measurement circuit 21 are mounted on the substrate 4B, only the thermosensitive devices RX1 and RX2 may be mounted on the substrates 4A and 4B respectively.

Figure 11:
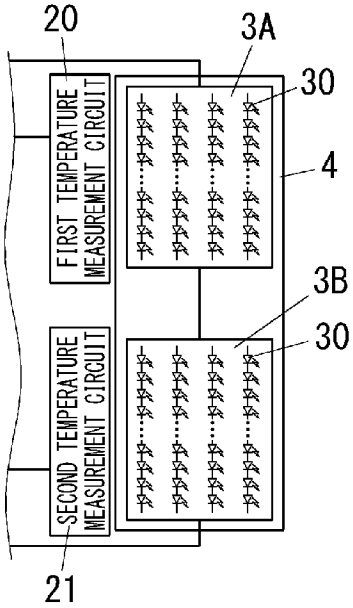
FIG. 11 is a diagram illustrating another example of the configuration where the light sources are connected in series.

Alternatively, as shown in FIG. 11, the light sources 3 (3A and 3B) may be mounted on the same substrate 4. This arrangement can provide the advantageous effect of the arrangement shown in FIG. 7 in addition to the advantageous effect of the arrangement where the light sources 3A and 3B are connected in series with each other.

Figure 12:
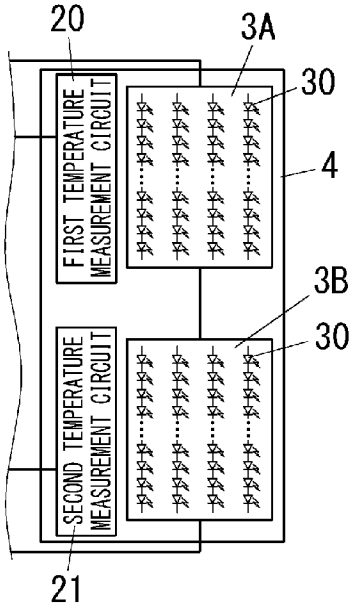
FIG. 12 is a diagram illustrating another example of the configuration where the light sources are connected in series.

Alternatively, as shown in FIG. 12, the light sources 3A and 3B and the temperature measurement circuits 20 and 21 may be mounted on the same substrate 4. With this arrangement, both advantageous effects of the arrangement shown in FIG. 6 and the arrangement shown in FIG. 7 may be achieved in addition to the advantageous effect of the arrangement where the light sources 3A and 3B are connected in series with each other. Note that, instead of mounting all the components of the temperature measurement circuits 20 and 21 on the substrate 4, only the thermosensitive devices RX1 and RX2 may be mounted on the substrate 4.

Further, the output control circuit 25 may control the output circuits 220 (23 and 24) by use of a data table shown in FIG. 13 instead of the data table shown in FIG. 3.

In this data table, until the digital value of each detection voltage exceeds a first threshold (corresponds to a first temperature and, herein, has a value of "100"), the control data set is "A0" irrespective of an amount of the digital value. Note that, the first temperature is determined in consideration of whether the plurality of light sources 3 can be cooled properly, even when the plurality of output circuits 220 has the same drive voltage, for example.

In other words, until any of the temperatures measured by the temperature measurement circuits 20 and 21 exceeds the first temperature, the output control circuit 25 controls the output circuits 23 and 24 in such a way to output the same drive voltage. Accordingly, the control manner can be simplified. Further, the control data sets can share the same data and therefore a volume of data can be reduced and a production cost can be reduced. Furthermore, it is possible to store data for implementing another function in an available space of the memory obtained by reducing the volume of the data and therefore the performance can be improved.

While the digital value of the first detection voltage exceeds the first threshold, the value of the first control data set increases from "A1" to "A155" with an increase in the digital value of the first detection voltage. Further, while the digital value of the second detection voltage exceeds the first threshold, the value of the second control data set increases from "B1" to "B155" with an increase in the digital value of the second detection voltage.

In summary, while any of the temperatures measured by the temperature measurement circuits 20 and 21 exceeds the first temperature, the output control circuit 25 controls the output circuits 23 and 24 in such a way to output different drive voltages.

As described above, when determining that all the temperatures respectively measured by the plurality of temperature measurement circuits 210 are equal to or less than the first temperature (first threshold), the output control circuit 25 may regulate the drive voltages of the plurality of output circuits 220 to the same voltage. In this case, when determining that at least one of the temperatures respectively measured by the plurality of temperature measurement circuits 210 exceeds the first temperature (first threshold), the output control circuit 25 may regulate the drive voltages of the plurality of output circuits 220 to different voltages.

In other words, the output control circuit 25 has a plurality of correspondence information pieces (the data tables in the present embodiment) each defining a correspondence relation between the temperatures and the drive voltages. The output control circuit 25 is configured to determine the drive voltages of the plurality of output circuits 220 based on the temperatures respectively measured by the plurality of temperature measurement circuits 210 by use of the plurality of correspondence information pieces. The plurality of correspondence information pieces have the same correspondence relation between the temperatures and the drive voltages in the range of equal to or less than the first temperature, whereas they have the different correspondence relations between the temperatures and the drive voltages in the range of more than the first temperature. Note that, the correspondence information piece may be the data table as described in the present embodiment or a function.

According to this arrangement, by decreasing the temperatures of the light sources 3A and 3B to avoid that the temperatures of the light sources 3A and 3B are kept high, it is possible to prevent a damage of the LED 30 due to the high temperature and to prolong the lifetimes of the light sources 3A and 3B.

Further, it is preferable to provide a dimming circuit for dimming the light sources 3A and 3B by regulating the output from the DC power source 1. The dimming circuit may be configured to, when the temperature measured by any of the temperature measurement circuits 20 and 21 exceeds the second temperature (greater than the first temperature), decrease the output from the DC voltage source 1. The second temperature is preferably set to, for example, a permissible operation temperature (e.g., the maximum permissible operation temperature) of the LED 30.

In brief, the lighting device further includes the dimming circuit configured to dim the plurality of light sources 3 by regulating power supplied from the power source 1 to the plurality of light sources 3. The dimming circuit is configured to, when determining that at least one of the temperatures respectively measured by the plurality of temperature measurement circuits 210 exceeds the second temperature, decrease the power supplied from the power source 1 to the plurality of light sources 3.

The following explanation is made to an example in which the output control circuit 25 serves as the dimming circuit described above. Note that, this dimming circuit may be provided as a separate part from the output control circuit 25.

When any of the digital values of the detection voltages exceeds a second threshold (corresponds to the second temperature and, herein, has a value of "200"), the CPU 25C of the output control circuit 25 reads out dimming control data from the memory 25D. Thereafter, the CPU 25C controls the DC power source 1 in such a way to decrease the output voltage of the DC power source 1 based on the dimming control data.

For example, the CPU 25C provides a dimming control signal to the switching device Q2 of the step-down chopper circuit 111, thereby decreasing the output voltage of the step-down chopper circuit 111 (i.e., the output voltage of the DC power source 1).

With this arrangement, when any of the temperatures of the light sources 3A and 3B becomes excessively high, the light sources 3A and 3B are dimmed such that the light outputs of the light sources 3A and 3B are decreased. Therefore, it is possible to visually notify a user of occurrence of abnormality of any of the light sources 3A and 3B through changes in the light outputs of the light sources 3A and 3B.

Note that, the dimming control data may be determined such that the light output is more decreased with an increase in the digital value of the detection voltage, or be determined such that the light output is kept at a constant dimming level. Additionally, when any of the digital values of the detection voltages exceeds the threshold for longer than a predetermined period, the output control circuit 25 may further decrease the output voltage of the DC power source 1, or terminate the operation of the DC power source 1.

Further, the output control circuit 25 may control the output circuits 220 (23 and 24) by use of a data table shown in FIG. 14 instead of the data table shown in FIG. 3.

In this data table, the first control data set ("TA0", . . . , "TA255") corresponding to the digital value of the first detection voltage and the second control data set ("TB0", . . . , "TB255") corresponding to the digital value of the second detection voltage are recorded.

Figure 15:
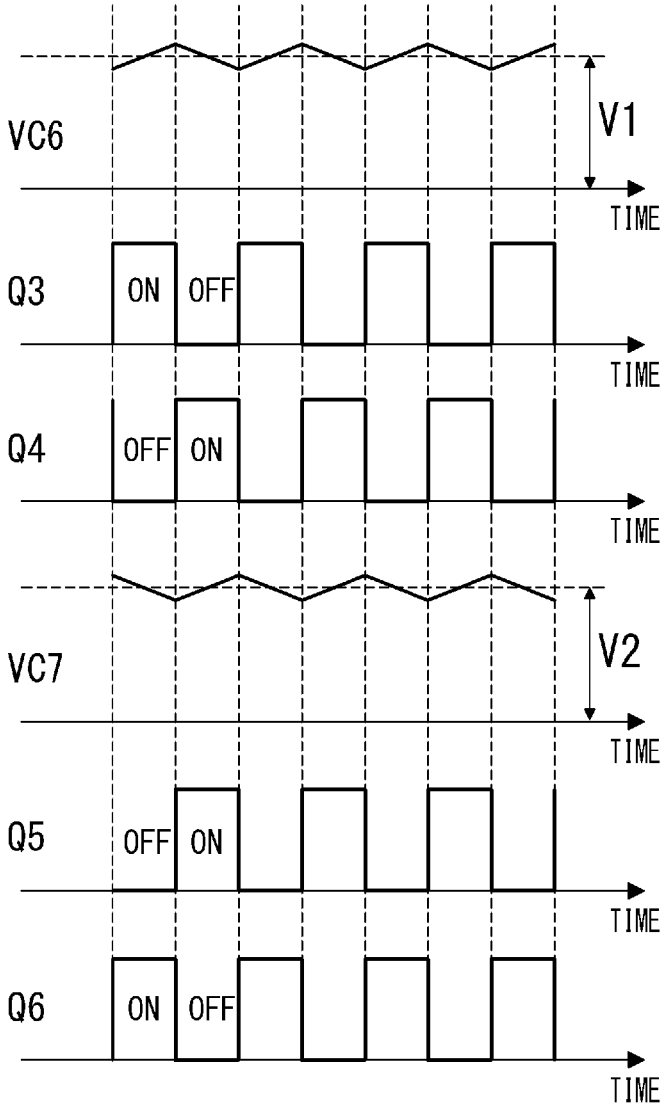
FIG. 15 is a waveform chart illustrating operation of each output circuit when the data table shown in FIG. 14 is used.

In this regard, the first control data set defines on-time and off-time of the switching device Q4, and the second control data set defines on-time and off-time of the switching device Q6. As shown in FIG. 15, the control data sets are determined such that a period in which the switching device Q4 is off does not overlap a period in which the switching device Q6 is off. For example, the off-time of the switching device Q4 determined by "TA0" of the first control data set does not overlap the off period of the switching device Q6 determined by any of the values of the second control data set.

Consequently, the switching device Q6 is kept turned on while the switching device Q4 is turned off, and therefore the output voltage of the power supply circuit 22 is supplied to only the first output circuit 23. Meanwhile, the switching device Q6 is kept turned off while the switching device Q4 is turned on, and therefore the output voltage of the power supply circuit 22 is supplied to only the second output circuit 24.

In brief, the output control circuit 25 controls the output circuits 23 and 24 to alternately receive the output voltage from the power supply circuit 22. In other words, the output control circuit 25 is configured to operate the plurality of output circuits 220 singly in order.

With this arrangement, in contrast to a configuration where the output voltage is supplied to the output circuits 23 and 24 simultaneously, the power supply circuit 22 can exert its potential as possible and the power supply circuit 22 can be downsized.

As described above, the lighting device of the present embodiment has the following first feature.

In the first feature, the lighting device of the present embodiment includes the power source 1 and the cooling control circuit 2. The power source 1 supplies power to the light source 3 including the solid state light emitting device. The cooling control device 2 includes the power supply circuit 22, the plurality of output circuits 220, the plurality of temperature measurement circuits 210, and the output control circuit 25. The power supply circuit 22 receives the power supply voltage from the power source 1 and outputs the constant voltage. Each of the plurality of output circuits 220 receives the output voltage from the power supply circuit 22 and outputs the drive voltage for operating the corresponding cooling device 9. Each of the plurality of temperature measurement circuits 210 measures the temperature of the corresponding light source 3. The output control circuit 25 controls each of the plurality of output circuits 220 in such a way to output the drive voltage based on the temperature measured by the corresponding temperature measurement circuit 210.

In other words, the lighting device includes: the power source 1 and the cooling control circuit 2. The power source 1 is configured to supply power to the plurality of light sources 3. The cooling control circuit 2 is configured to control the plurality of cooling devices 9 for respectively cooling the plurality of light sources 3. The cooling control circuit 2 includes the power supply circuit 22, the plurality of output circuits 220, the plurality of temperature measurement circuits 210, and the output control circuit 25. The power supply circuit 22 is configured to output the constant voltage by use of power from the power source 1. The plurality of output circuits 220 are configured to receive the constant voltage from the power supply circuit 22 and supply the drive voltages to the plurality of cooling devices 9 to drive the plurality of cooling devices 9, respectively. The plurality of temperature measurement circuits 210 are each configured to measure temperatures of the plurality of light sources 3 respectively. The output control circuit 25 is configured to regulate the drive voltages to be respectively supplied from the plurality of output circuits 220 based on the temperatures respectively measured by the plurality of temperature measurement circuits 210.

Further, the lighting device of the present embodiment has the following second feature. Besides, the second feature is optional.

With regard to the second feature, in addition to the first feature, the output control circuit 25 controls each of the output circuits 220 based on an average, in a predetermined period, of temperatures measured by a corresponding temperature measurement circuit 210. In other words, the output control circuit 25 is configured to calculate an average temperature in a predetermined period for each of the plurality of temperature measurement circuits 220, and regulate each of the drive voltages of the plurality of output circuits 220 based on the average temperature of a corresponding one of the plurality of temperature measurement circuits 210.

Further, the lighting device of the present embodiment has the following third and fourth features. Besides, the third and fourth features are optional.

With regard to the third feature, in addition to the first or second feature, until any of the temperatures measured by the temperature measurement circuits 210 exceeds the first temperature, the output control circuit 25 controls the output circuits 220 in such a way to output the same drive voltage. While any of the temperatures measured by the temperature measurement circuits 210 exceeds the first temperature, the output control circuit 25 controls the output circuits 220 in such a way to output different drive voltages.

In other words, the output control circuit 25 is configured to, when determining that all the temperatures respectively measured by the plurality of temperature measurement circuits 210 are not equal to or less than the first temperature, regulate the drive voltages of the plurality of output circuits 220 to the same voltage. The output control circuit 25 is configured to, when determining that at least one of the temperatures respectively measured by the plurality of temperature measurement circuits 210 exceeds the first temperature, regulate the drive voltages of the plurality of output circuits 220 to different voltages.

With regard to the fourth feature, in addition to the first or second feature, the output control circuit 25 has a plurality of correspondence information pieces each defining a correspondence relation between the temperatures and the drive voltages. The output control circuit 25 is configured to determine the drive voltages of the plurality of output circuits 220 based on the temperatures measured by the plurality of temperature measurement circuits 210 by use of the plurality of correspondence information pieces. The plurality of correspondence information pieces have the same correspondence relation between the temperatures and the drive voltages in the range of equal to or less than the first temperature, and have the different correspondence relations between the temperatures and the drive voltages in the range of more than the first temperature.

Further, the lighting device of the present embodiment has the following fifth to eleventh features. Besides, the fifth to eleventh features are optional.

With regard to the fifth feature, in addition to any one of the first to fourth features, the output control circuit 25 controls the output circuits 23 and 24 to alternately receive the output voltage from the power supply circuit 22. In other words, the output control circuit 25 is configured to operate the plurality of output circuits 220 singly in order.

With regard to the sixth feature, in addition to any one of the first to fifth features, the lighting device includes the dimming circuit (the output control circuit 25, in the present embodiment) for dimming each light source 3 by varying the output from the power source 1. The dimming circuit decreases the output from the power source 1 when the temperature measured by any of the temperature measurement circuits 210 exceeds the second temperature greater than the first temperature.

In other words, the lighting device further includes the dimming circuit configured to dim the plurality of light sources 3 by regulating power supplied from the power source 1 to the plurality of light sources 3. The dimming circuit is configured to, upon determining that at least one of the temperatures respectively measured by the plurality of temperature measurement circuits 210 exceeds the second temperature, decrease the power supplied from the power source 1 to the plurality of light sources 3.

With regard to the seventh feature, in addition to any one of the first to sixth features, each of the plurality of temperature measurement circuits 210 includes the thermosensitive device (RX1, RX2) having a characteristic value varying with a temperature.

With regard to the eighth feature, in addition to the seventh feature, the thermosensitive device (RX1, RX2) is an NTC thermistor, a PTC thermistor, or a CTR thermistor.

With regard to the ninth feature, in addition to any one of the first to eighth features, each of the plurality of cooling devices 9 is configured to increase the cooling capacity thereof with an increase in the drive voltage supplied thereto. The output control circuit 25 is configured to increase the drive voltage with regard to each of the plurality of the output circuits 220 with an increase in the temperature measured by a corresponding one of the plurality of temperature measurement circuits 210.

With regard to the tenth feature, in addition to any one of the first to ninth features, the power source 1 includes: the first circuit (step-up chopper circuit) 110 configured to generate an output voltage which is constant; and the second circuit (step-down chopper circuit) 111 configured to supply power to the plurality of light sources 3 by use of the output voltage generated by the first circuit 110. The power supply circuit 22 is configured to output the constant voltage by use of the output voltage generated by the first circuit 110.

With regard to the eleventh feature, in addition to any one of the first to tenth features, each of the plurality of light sources 3 is a solid state light emitting device.

As described above, according to the lighting device of the present embodiment, each output circuit 220 receives the output voltage from the single power supply circuit 22 and provides the drive voltage based on the temperature measured by a corresponding temperature measurement circuit 210. Hence, according to the lighting device of the present embodiment, it is unnecessary to change the configuration of the power supply circuit 22 in accordance with a lighting fixture structure and a heat dissipation structure. Additionally, in the lighting device of the present embodiment, LEDs for providing power for cooling devices as disclosed in the prior art are not necessary. Hence, there is no need to use an LED capable of withstanding an increase in a forward current and therefore the production cost can be reduced.

Figure 16:
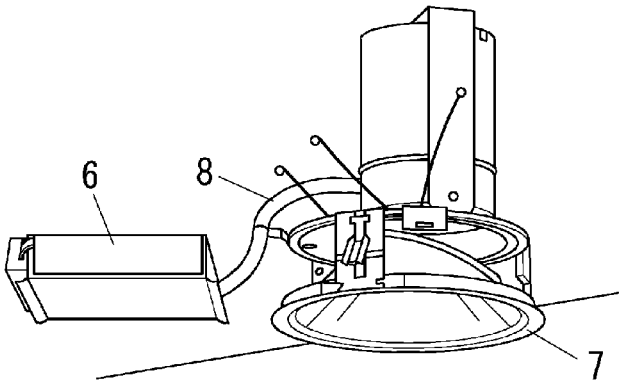
FIG. 16 is a schematic diagram illustrating an embodiment of a lighting fixture in accordance with the present invention.
Figure 17:
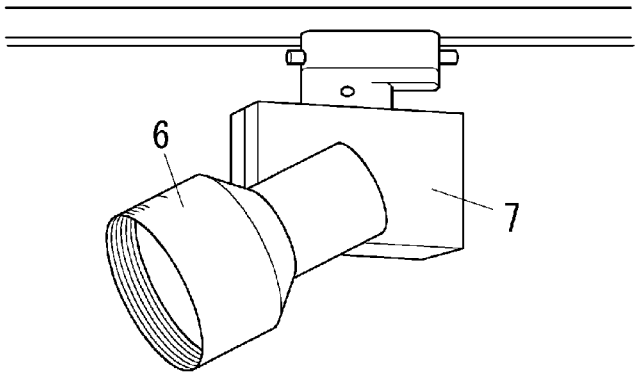
FIG. 17 is a schematic diagram illustrating another embodiment of the lighting fixture in accordance with the present invention.
Figure 18:
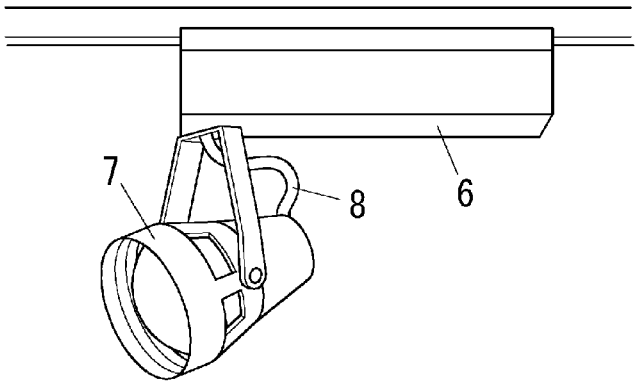
FIG. 18 is a schematic diagram illustrating another embodiment of a lighting fixture in accordance with the present invention.

The lighting device of the present embodiment is available for lighting fixtures shown in FIGS. 16 to 18, for example.

Each of the lighting fixtures illustrated in FIGS. 16 to 18 includes a lighting device 6 corresponding to the above embodiment, and a fixture body 7. The fixture body 7 is configured to hold the light sources 3A and 3B and the fans 51A and 51B (the cooling devices 9A and 9B).

In these instances, it is preferable that the thermosensitive devices RX1 and RX2 of the lighting device 6 be positioned close to the light sources 3A and 3B respectively. Hence, the thermosensitive devices RX1 and RX2 are held by the fixture body 7. Note that, the light source 3A and 3B and the thermosensitive devices RX1 and RX2 are not shown in FIGS. 16 to 18.

In this regard, the lighting fixture shown in FIG. 16 is a down light, and the lighting fixtures shown in FIGS. 17 and 18 are spot lights. In the lighting fixtures shown in FIGS. 16 and 18, the lighting device 6 is connected to the light sources 3A and 3B through a cable 8.

The lighting fixture of the present embodiment includes the lighting device 6 described above and the fixture body 7 for holding each light source 3 and each cooling device 9.

In other words, the lighting fixture of the present embodiment includes the fixture body 7 for holding the plurality of light sources 3 and the plurality of cooling devices 9, and the lighting device 6 having the aforementioned first feature, for controlling the plurality of light sources 3 and the plurality of cooling devices 9. Note that, the lighting device 6 may have at least one of the aforementioned second to eleventh features, if needed.

By using the lighting device 6 of the embodiment described above, the lighting fixture of the present embodiment can provide the same effect as the embodiment described above.

As described above, according to the lighting fixture of the present embodiment, each output circuit 220 receives the output voltage from the single power supply circuit 22 and provides the drive voltage based on the temperature measured by a corresponding temperature measurement circuit 210. Hence, according to the lighting fixture of the present embodiment, it is unnecessary to change the configuration of the power supply circuit 22 in accordance with a lighting fixture structure and a heat dissipation structure. Additionally, in the lighting fixture of the present embodiment, LEDs for providing power for cooling devices as disclosed in the prior art are not necessary. Hence, there is no need to use an LED capable of withstanding an increase in a forward current and therefore the production cost can be reduced.

Note that, the lighting fixture described above may be used alone but a plurality of lighting fixtures described above may be used to constitute a lighting system.

The invention claimed is:

1. A lighting device, comprising:

a power source configured to supply power to a plurality of light sources; and a cooling control circuit configured to control a plurality of cooling devices for respectively cooling the plurality of light sources, wherein:

the cooling control circuit includes a power supply circuit configured to output a constant voltage by use of power from the power source, a plurality of output circuits configured to receive the constant voltage from the power supply circuit and supply drive voltages to the plurality of cooling devices to drive the plurality of cooling devices, respectively, a plurality of temperature measurement circuits configured to measure temperatures of the plurality of light sources respectively, an output control circuit configured to regulate the drive voltages respectively supplied from the plurality of output circuits based on the temperatures respectively measured by the plurality of temperature measurement circuits.

2. The lighting device as set forth in claim 1, wherein the output control circuit is configured to calculate an average temperature in a predetermined period for each of the plurality of temperature measurement circuits, and regulate each of the drive voltages of the plurality of output circuits based on the average temperature of a corresponding one of the plurality of temperature measurement circuits.

3. The lighting device as set forth in claim 1, wherein the output control circuit is configured to, when determining that all the temperatures respectively measured by the plurality of temperature measurement circuits are not greater than a first temperature, regulate the drive voltages of the plurality of output circuits to a same voltage, and when determining that at least one of the temperatures respectively measured by the plurality of temperature measurement circuits is greater than the first temperature, regulate the drive voltages of the plurality of output circuits to different voltages.

4. The lighting device as set forth in claim 1, wherein:

the output control circuit has a plurality of correspondence information pieces each defining a correspondence relation between the temperatures and the drive voltages;

the output control circuit is configured to determine the drive voltages of the plurality of output circuits based on the temperatures respectively measured by the plurality of temperature measurement circuits by use of the plurality of correspondence information pieces; and the plurality of correspondence information pieces have the same correspondence relation between the temperatures and the drive voltages in a range of equal to or less than a first temperature, and have the different correspondence relations between the temperatures and the drive voltages in a range of more than the first temperature.

5. The lighting device as set forth in claim 1, wherein the output control circuit is configured to operate the plurality of output circuits singly in order.

6. The lighting device as set forth in claim 1, further comprising a dimming circuit configured to dim the plurality of light sources by regulating power supplied from the power source to the plurality of light sources, wherein the dimming circuit is configured to, when determining that at least one of the temperatures respectively measured by the plurality of temperature measurement circuits exceeds a second temperature, decrease the power supplied from the power source to the plurality of light sources.

7. The lighting device as set forth in claim 1, wherein each of the plurality of temperature measurement circuits includes a thermosensitive device having a characteristic value varying with a temperature.

8. The lighting device as set forth in claim 7, wherein the thermosensitive device is an NTC thermistor, a PTC thermistor, or a CTR thermistor.

9. The lighting device as set forth in claim 1, wherein:

each of the plurality of cooling devices is configured to increase a cooling capacity thereof with an increase in the drive voltage supplied thereto; and the output control circuit is configured to increase the drive voltage with regard to each of the plurality of the output circuits with an increase in the temperature measured by a corresponding one of the plurality of temperature measurement circuits.

10. The lighting device as set forth in claim 1, wherein:

the power source includes a first circuit configured to generate an output voltage which is constant, and a second circuit configured to supply power to the plurality of light sources by use of the output voltage generated by the first circuit; and the power supply circuit is configured to output the constant voltage by use of the output voltage generated by the first circuit.

11. The lighting device as set forth in claim 1, wherein each of the plurality of light sources is a solid state light emitting device.

12. A lighting fixture, comprising:

a fixture body for holding a plurality of light sources and a plurality of cooling devices; and a lighting device according to claim 1, for controlling the plurality of light sources and the plurality of cooling devices.

* * * * *